US007919700B2

(12) United States Patent
Saragosa

(10) Patent No.: US 7,919,700 B2
(45) Date of Patent: Apr. 5, 2011

(54) KALIMBA SYSTEM

(76) Inventor: William A Saragosa, Weilheim (DE)

( * ) Notice: Subject to any disclaimer, the term of this patent is extended or adjusted under 35 U.S.C. 154(b) by 126 days.

(21) Appl. No.: 12/378,367

(22) Filed: Feb. 14, 2009

(65) Prior Publication Data

US 2009/0217802 A1 Sep. 3, 2009

Related U.S. Application Data

(60) Provisional application No. 61/067,355, filed on Feb. 28, 2008.

(51) Int. Cl.
*G10D 13/08* (2006.01)

(52) U.S. Cl. ..... 84/402

(58) Field of Classification Search ..... 84/402–410
See application file for complete search history.

(56) References Cited

U.S. PATENT DOCUMENTS

D217,641 S * 5/1970 Pavia ..... D17/2

* cited by examiner

*Primary Examiner* — Kimberly R Lockett

(57) ABSTRACT

A musical instrument held and played by hand such as a kalimba having a hollow sound chamber and an angled footing mounting on an outer surface of the sound chamber. A plurality of interchangeable one piece key plate mounted to the angled footing each key plate including a plurality of keys, each key having a length corresponding to a permanent preset musical tone or note. Each interchangeable key plate can have a set of musical sounds different from other key plates such that a musician can change key plates to change the style of music played, or to suit the desired educational environment.

16 Claims, 6 Drawing Sheets

KALIMBA SYSTEM

CROSS REFERENCES TO RELATED APPLICATIONS

U.S. Provisional Application Patent No. 61/067,355, filed Feb. 28, 2008, with title "Key and tuning device/system for a kalimba" which is hereby incorporated by reference. Applicant claims priority pursuant to 35 U.S.C. par. 119(e)(i).

Statement as to rights to inventions made under Federally sponsored research and development: Not Applicable

BACKGROUND OF THE INVENTION

1. Field of the Invention

The present invention relates generally to a musical instrument such as a kalimba, thumb piano, marimbula or other melodic percussion instrument.

2. Brief Description of Prior Art

The Kalimba is a traditional African musical instrument, sometimes called a Mbira, marimbula, thumb piano or Lamellophone. Musical notes are produced by resonant keys or bars which are suspended over a resonant body. The keys or bars are traditionally of metal, such as hammered wire, or strips of metal banding material. The bars are pressed and released by a musician in such a way that they vibrate at a pitch specific to the length of the bar. The desired tuning is traditionally achieved by adjusting the length individual key exposed over an isolating element known as a bridge. The greater the length of the key results in a lower pitch of sound.

In the prior art, each individual key typically 5 to 25 in number have to be adjusted individually, and typically requires a cumbersome apparatus to semi-permanently secure it in place. This arrangement is prone to slipping and going out of tune during use. It requires a person highly skilled in the art to properly adjust the tuning of a traditional kalimba.

It is difficult and time consuming to change the timbre or musical 'color' of the instrument, which can only be achieved by substituting one type of key for another, ie steel for bronze or plastic. As a result, this form of musical variation is almost never employed.

The amount of pressure required to maintain the individual keys in place on a traditional kalimba with individual keys can be enough to damage the thin wood from which kalimbas are typically constructed. The arrangement often results in unequal pressure on keys resulting in slipping, structural and aesthetic problems. As a result kalimbas are often built in such a way that they are heavy. Since kalimbas are hand held, it is desirable to have the kalimba as light as possible. A thinner, hollow construction is inherently more resonant than a thicker, solid amusement device rather than a serious musical instrument.

U.S. Pat. No. 2,493,119 discloses a musical comb having a plurality of pluckable teeth. The patent includes a horn that allows for interchangable combs each comb carrying a specific song 'recorded' in the shape of the comb teeth such that running a finger along the teeth reproduces the 'recorded' song. The device requires no musical skill and does not encourage creativity. It is more of an amusement device rather than a serious musical instrument.

U.S. Pat. No. 3,610,085 shows an example prior art kalimba. In this case there are a plurality of individual keys that can be inserted, tuned and replaced. This instrument is versatile but is very time consuming to tune and difficult to keep in tune. When the wood and screws are over tightened, or just worn with age/use, the threads will be eventually stripped and the kalimba no longer able to hold the tune at all.

U.S. Pat. No. 3,961,553 discloses another prior art kalimba with a plurality of individual keys having generally the same limitation of being difficult to use. The individual keys are longer than functionally necessary and project out the end of the instrument in a hazardous cumbersome way that adds to the difficulty of using and transporting the device. Another disadvantage is that if one key is broken due to damage or fatigue or lost it is nearly impossible to locate or fabricate a replacement key that fits the musical timbre of the remaining keys, as a result all the keys must be replaced or more often the kalimba is retired or discarded.

As can be seen, there is a need for an improved kalimba that would be appropriate for the serious musician who wishes to easily achieve a greater range in musical expression and wishes to assure a ready supply of precisely replaceable musical notes. There is also a need for a kalimba that may present a beginner with two or three keys in a highly simplified manner, which can easily be "upgraded" or made slightly more complex (challenging) within a single unit of classroom time.

SUMMARY OF THE INVENTION

A hand held musical instrument such as a kalimba has a hollow sound chamber and an angled footing mounting on a top surface of the sound chamber. A plurality of interchangeable one piece key plates adapted to be mounted to the footing, the one piece key plates each including a plurality of keys. Each key has a length corresponding to a permanent preset musical tone. Each of the plurality of key plates is capable of producing a set of musical sounds that is different from the other key plates.

DESCRIPTION OF THE PREFERRED EMBODIMENT

Figure 1:
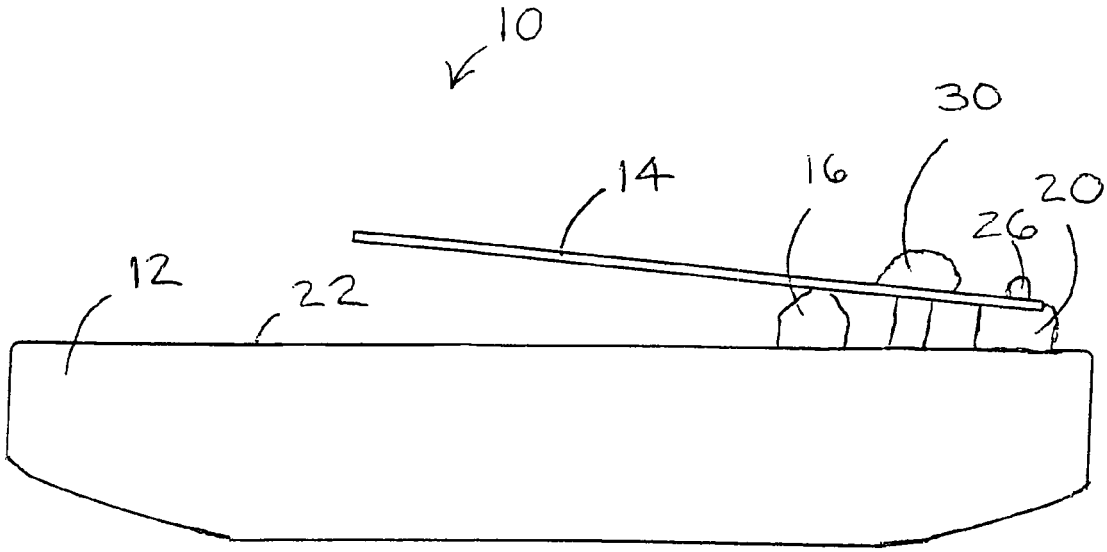
FIG. 1 shows a side view of the instrument.
Figure 2:
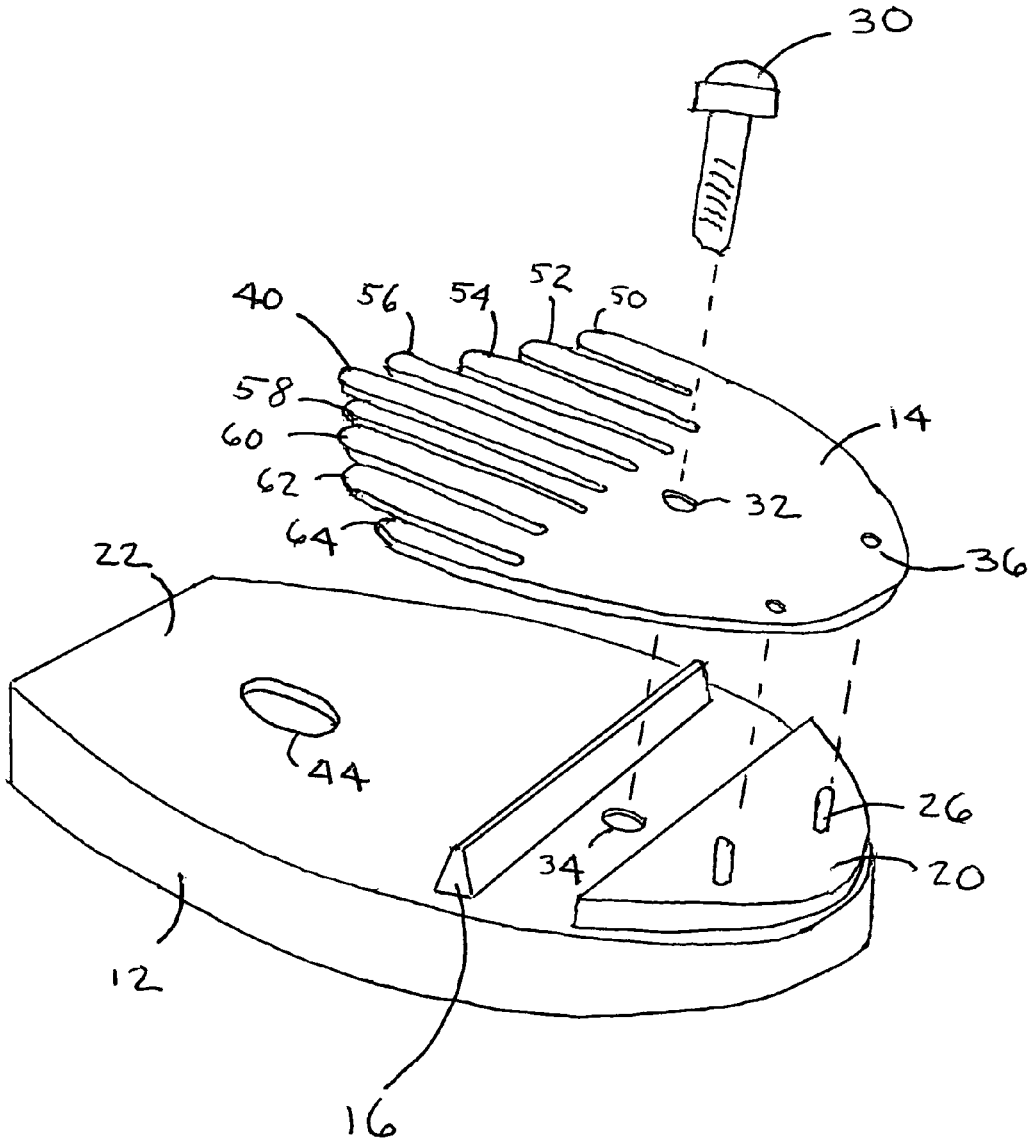
FIG. 2 shows an exploded view of the apparatus of FIG. 1.

In accordance with the present invention, FIG. 1 shows a side view of the instrument which is a kalimba 10. The kalimba 10 includes a body resonant sound chamber 12 that could be a hollow wood chamber or could be made of other material such as metal, plastic or fiberglass for example, it is also possible to have a solid body kalimba. Ideally the chamber 12 will have thin walls to enhance resonation and thus the sound of the instrument. The kalimba includes a one piece key plate 14. The key plate 14 can be formed from a single plate of stamped or machined metal or other material, composite, fiberglass, wood, or any other material suitable for producing a vibration and suitable for employment in sheet or plate form for example and might be made from a variety of metals such as steel, brass, or aluminum. Any metal type and thickness could be used to achieve a variety of musical tones or sounds. The key plate 14 rests on a bridge 16 and on an angled footing 20. The footing 20 would typically have an angle of about 5 degrees relative to the top surface 22 of the body chamber 12. The key plate 14 sits over at least one locator such as locator dowel pin 26, in the embodiment shown two locator dowel pins 26 precisely locate the key plate 14 relative to the body chamber 12 and the bridge 16. A fastener such as a thumb screw 30 can be used to secure the key plate 14 to the body chamber 12. The thumbscrew 30 may be flanged or provided with a washer or other element suitable for evenly distributing pressure across the surface of the key plate 14. Each key 40, 50, 52, 54, 56, 58, 60, 62 and 64 has a different length and each key has a permanent preset musical tone that is set at the time of manufacturing. Each key 40, 50, 52, 54, 56, 50, 60 and 64 has an end adapted to be plucked by a user's finger such that the kalimba 10 can be held in a musician's hands and played by hand or by a device, such as a dulcimer hammer, by the user pressing and releasing or stimulating the end of each key 40, 50, 52, 54, 56, 58, 60, 62, 64 to play different notes. The bridge 16 and footing 20 could be a single piece. The key plate of the Kalimba is unique with the longest key 58 in the center and key length decreasing from the center longest key outward. The reason is that the kalimba is typically held cradled in the musicians hands and the keys are played with the thumbs, one thumb on each side FIG. 2 shows an exploded view of the kalimba 10. The key plate 14 has a clearance hole 32 to accept threaded fastener 30 which threads into a hole 34 in the top surface 22 of the body chamber 12. The key plate 14 has two additional holes 36 that fit over registration dowel pins 26 to align the key plate 14, so the spacing of the holes 36 corresponds exactly to the spacing of registration dowel pins 26. The pins 26 could be hard rubber or Teflon coated to reduce vibration. It is important that the key plate 14 align with the bridge 16 as this positioning has some effect on the sound. The bridge 16 is a straight support under the key plate 14 and each key has a different length such that the end of the keys 40, 50, 52, 54, 56, 58, 60, 62, 64 can present a staggered arrangement. The key plate 14 has 9 individual keys 40, 50, 52, 54, 56, 58, 60, 62, 64 each key corresponding to a particular note or musical sound for example. The top surface 22 of the body sound chamber 22 includes a sound opening such as round resonance hole 44. When the kalimba 10 is assembled no tuning is required, so a single fastener 30 allows for assembly and dis-assembly of the kalimba 10. FIG. 2 shows that the end of each key 40, 50, 52, 54, 56, 58, 60, 62 and 64 can be rounded or bent down to improve the feel of the instrument and eliminate sharp edges.

Figure 3:
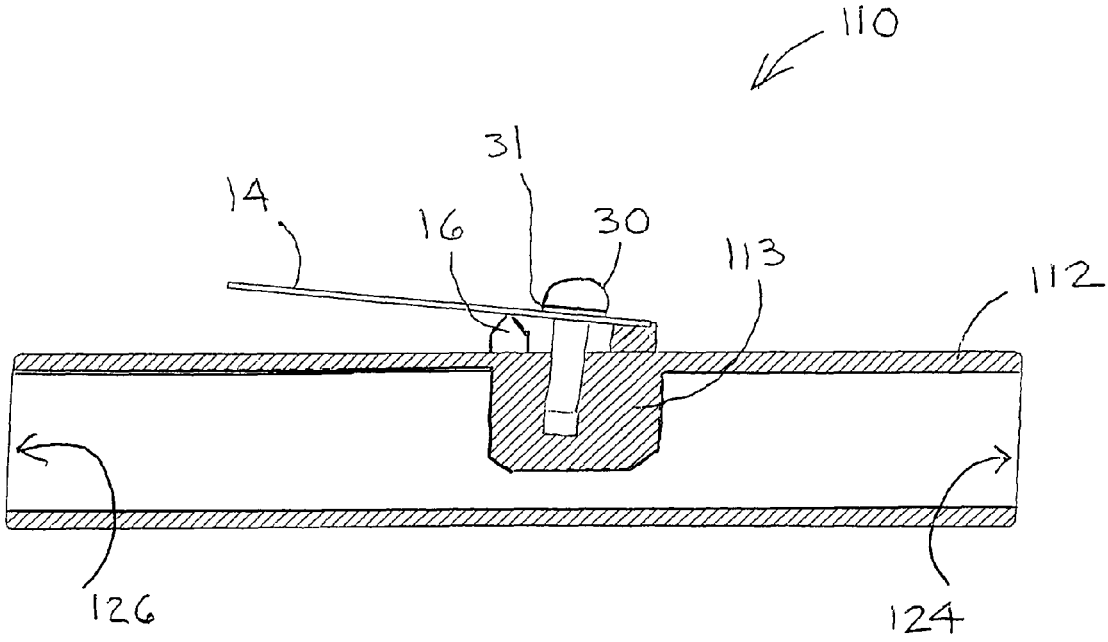
FIG. 3 shows a partial cutaway view of an alternate embodiment.

FIG. 3 shows an alternate embodiment of the manually played kalimba 110. The kalimba 110 includes a body sound chamber 112 that includes a support 113 and is basically a hollow shape such as a rectangular tube. The body 112 has two open ends 124, 126 and the sound of the instrument can be changed by covering the holes 124, 126. For example when holding the kalimba 110 in the player's hands holding one end 126 against the users stomach to alternatively open and seal the hole 126 will change the sound in what is known as a 'waa waa' effect. The kalimba includes a key plate 14, bridge 16 and angled footing 20 that can be the same as the kalimba 10. Thus a musician could own two or more body chambers 12 and 112 and could interchange the other components to allow for variety. The alternate body 112 is a different shape, it could also be larger and could be made of a different material. Any of these changes would result in a different sound even with the same key plate 14. The embodiment 110 shows a padding washer 31 under the head of the thumb screw 30 to reduce vibration. The body chamber 112 of the embodiment of FIG. 3 would fit comfortably in the hands of a musician or on a surface to be played by hand.

Figure 4:
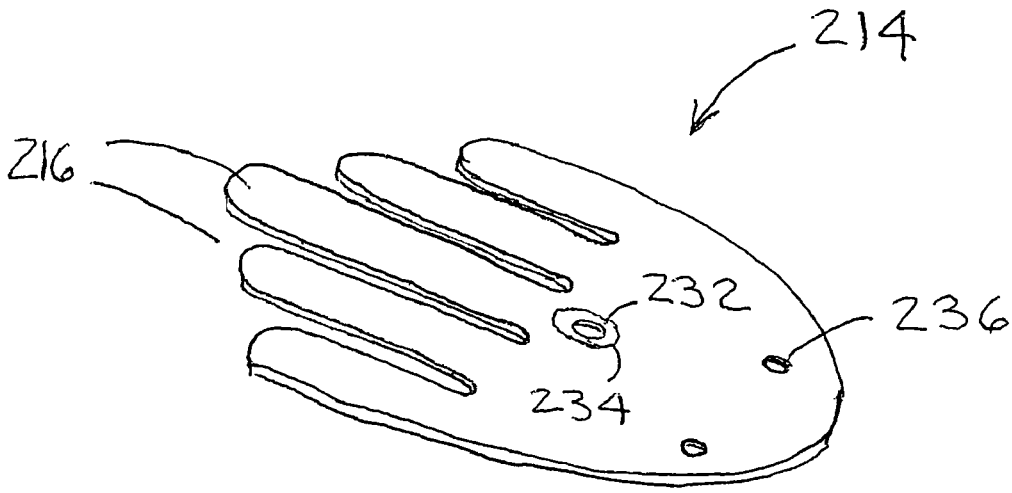
FIG. 4 shows an alternate key plate.

FIG. 4 shows an alternate key plate 214. The key plate 214 includes 5 keys 210, 212, 216, 218 and 220. The key plate 214 includes holes 236 sized and spaced to fit exactly over the dowel pins locators 26 such that the key plates 14 and 214 are interchangeable as are the sound chambers 12 and 112 such that a variety of instruments can be formed. The key plate 214 includes a hole 232 that allows the threaded fastener to loosely fit through. The key plate 214 can include a depression 234 surrounding the opening 232 such that the head of the thumb screw 30 will be at or below the top surface of the key plate 214 to create a cleaner design. The dowel pin locators 26 fit the holes 36 tight and the hole 32 is loose around fastener 30 such that the dowels 26 locate the key plate 14, 214 over the bridge 16 while the thumb screw 30 secures the key plate 14, 214 in place.

Figure 5:
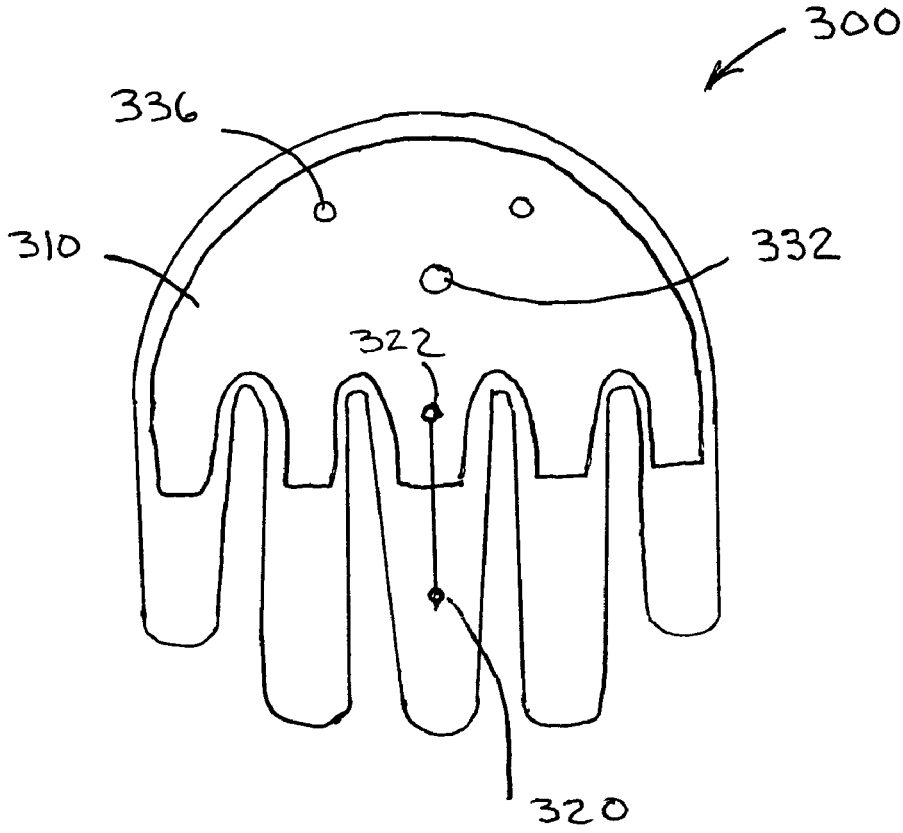
FIG. 5 shows a second alternate key plate.

FIG. 5 shows an alternate key plate 300. The key plate 300 includes openings 336 for dowel pins 26 to locate the key plate 300. Also a clearance hole 332 for the fastener 30 to pass through to lock the key plate 300 in place after it is located. The key plate 300 is prepared with sound enhancements. Musicians often like to adapt a standard piece of musical equipment to create a unique sound, this process is known as preparing the instrument. For example, the key plate 300 could be made by starting with the key plate 14 and placing a mask 310 over it. The mask 310 can be of material such as cloth, fabric or gasket material that would tend to dampen vibration and thus change the sound of the key plate 300. The mask could be attached to the key plate 300 such as by adhesives. A mask 310 could cover part of the key plate 300 as shown or could cover the entire key plate 300 for example. Another way to vary sound is to attach items such as a wire mounted bead 320. The bead 320 is attached to the key plate 300 by drilling a hole 322 in the key plate 300. The wire mounted bead 320 would tend to vibrate and strike the key plate 300 creating a rattle sound. These preparations allow the musician to experiment with the sound of the Kalimba making the music bright or muted or changing the color or tone of the music for example. The present invention allows greater exploration because a key plate 300 that has been prepared can be removed from the Kalimba 10 and stored so that the exact sound created can be revisited and reproduced later on simply by interchanging key plates 14, 214, 300. The prepared key plate 300 is shown for example, musicians could prepare and experiment with many different prepared key plates and could use several during a performance. In educational settings, students could be encouraged to conduct their own experiments in preparing a key plate 14 because alterations to the key plate 14 would not otherwise damage the kalimba 10. This makes the kalimba 10 a much more valuable teaching tool.

In use plucking or stroking or otherwise stimulating the keys 40 will produce musical notes that resonate in sound chamber 12 to amplify the sound. A musician can carry a plurality of sound chambers 12, 112 and others that vary in musical quality by changing parameters such as size, shape, and material for example. A musician can also carry a plurality of interchangeable key plates 14, 214 and others that vary in number of keys, size and shape of key, material the keys are made from and thickness of the keys for example, each key plate 14, 214 capable of producing a different set of musical sounds. By varying these factors a musician can form many variations of the instrument while carrying only a few parts.

The kalimba 10 can include a case that could receive the kalimba 10 and that would have pins matching pins 26 that could receive a plurality of interchangeable key plates 14, 214 and others. The case would protect the instrument and allow it to be carried to performances. The kalimba 10 can be changed by removing the one fastener 30, changing the key plate 14 for a different one, locating the new key plate over the locator dowel pins 26 and then refastening the threaded fastener 30. The key plates 14 are positioned by the dowel pin locators 26 and since the key plate 14 is always tuned the threaded fastener 30 can be placed finger tight, this prevents damage that often occurs with prior art kalimbas when the tuning fasteners are over tightened. A locking mechanism (not shown), such as a counter-tension nut, could be used to prevent the key plate 14 from loosening.

Figure 6:
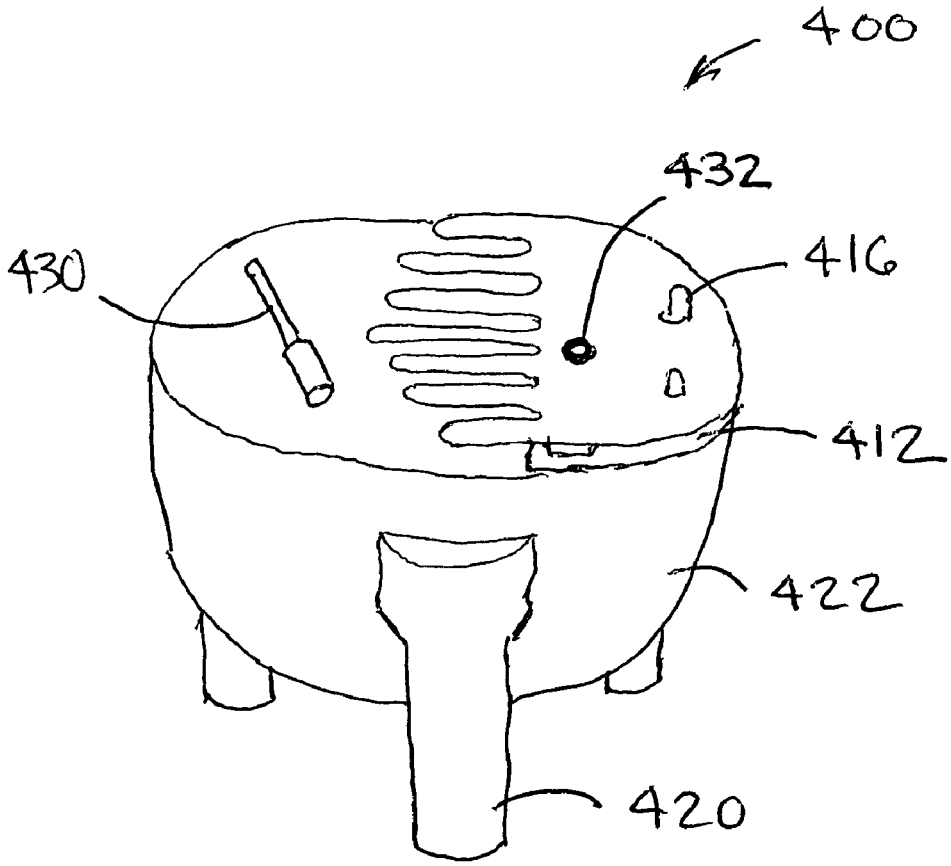
FIG. 6 shows another embodiment of the invention.

FIG. 6 shows an example standing model instrument 400 on legs 402. This instrument 400 is larger and has a one piece key plate 414 located on pins 416 and attached 432 to a one piece bridge and footing assembly 412. The instrument 400 is mounted on three legs 420 which support a hollow drum body 422. The instrument 400, like the kalimba 10 could be played by hand and it can be played with a striking instrument such as a hammer 430. The larger instrument 400 could be played by a person sitting, in a wheel chair or standing for example. Like the other kalimbas the standing model instrument 400 could have inter-changeable key plates 414.

Although the description above contains many specificities, these should not be construed as limiting the scope of the invention but as merely providing illustrations of some of the presently preferred embodiments of this invention. As such, it is understood that the present invention is not limited to the embodiments described above, but encompasses any and all embodiments within the scope of the claims.

It will be obvious to those skilled in the art that modifications may be made to the embodiments described above without departing from the scope of the invention. Thus the scope of the invention should be determined by the claims in the formal application and their legal equivalents, rather than by the examples given.

I claim:

1. A hand held musical instrument having;

a hollow sound chamber;

an angled footing mounting on a top surface of said sound chamber;

a first one piece key plate mounted to said angled footing;

said one piece key plate including a plurality of keys, each key having a length corresponding to a permanent preset musical tone and wherein the longest key is centered on the key plate.

2. The musical instrument of claim 1 wherein each key has an end adapted to be played by finger.

3. The musical instrument of claim 1 wherein said top surface of said sound chamber includes at least one locator pin for locating said first one piece key plate over a bridge and wherein said top surface of said sound board includes at least one fastener to releasably lock said key plate to said top surface of said sound board.

4. The musical instrument of claim 1 wherein said instrument includes a plurality of interchangeable key plates including said first key plate, wherein said first key plate has a number of keys and a second key plate having more keys than said first key plate.

5. The musical instrument of claim 1 wherein said instrument includes a plurality of interchangeable key plates including said first key plate, wherein said the keys of said first key plate are capable of producing a first set of musical sounds and at least a second key plate capable of producing a second set of musical sounds that are different from said first set of musical sounds.

6. The musical instrument of claim 1 wherein said instrument includes a plurality of key plates including said first key plate and wherein each key plate has a set of alignment openings and wherein said footing includes a plurality of locators adapted to fit said alignment openings to repeatably locate said key plates over a bridge and wherein each key plate includes a hole adapted to accept a fastener for fastening one of said plurality of key plates to said top surface of said sound chamber and wherein at least one key plate has been prepared by adding sound enhancement elements.

7. A kalimba instrument having;

a resonating base;

a footing mounting on a top surface of said resonating base;

a first one piece key plate mounted to said footing;

said one piece key plate including a plurality of keys, each key having a length corresponding to a permanent preset musical sound.

8. The kalimba of claim 7 wherein a top surface of said resonating base includes at least one locator dowel pin for precisely locating said first one piece key plate over a bridge and wherein said top surface of said resonating base includes at least one hole loosely receiving a fastener to releasably hold said key plate to said top surface of said resonating base.

9. The kalimba of claim 8 wherein said kalimba includes a plurality of interchangeable key plates including said first key plate, wherein said the keys of said first key plate are capable of producing a first set of musical sounds and at least a second key plate capable of producing a second set of musical sounds that are different from said first set of musical sounds.

10. The kalimba of claim 9 wherein said first key plate has a number of keys and said second key plate has more keys than said first key plate and wherein said resonating base includes a resonance hole below said first key plate.

11. The kalimba of claim 9 wherein said first key plate has finger keys to produce a first set of musical sounds and said second key plate has finger keys capable of producing a different set of musical sounds and wherein each key plate has a longest key in the center of the key plate.

12. A kalimba instrument having;

a base holding a sound chamber;

a footing mounting on a surface of said sound chamber;

a plurality of one piece key plates adapted to be interchangably mounted to said footing;

said plurality of one piece key plate including a plurality of keys, each key having a length corresponding to a permanent preset musical sound and each key having an end adapted to play by hand.

13. The kalimba of claim 12 wherein a surface of said base includes at least one locator dowel pin for precisely locating one key plate of said plurality one piece key plate over a bridge and wherein said surface of said base includes at least one hole loosely receiving a fastener to releasably hold said one key plate to said surface of base.

14. The kalimba of claim 12 wherein said surface of said base includes a plurality of locator pins for locating said one of said plurality of one piece key plates over a bridge and wherein said top surface of said base includes at least one threaded hole to receive a fastener to releasably hold said one key plate to said surface of said base.

15. The kalimba of claim 14 wherein each key plate of said plurality of key plates has a set of keys corresponding to a set of musical sounds that is different from other key plates.

16. The kalimba of claim 15 wherein said sound chamber includes a resonance hole below said one key plate and wherein said key plate has been prepared by adding sound enhancement elements.

* * * * *